US007195242B2

(12) United States Patent
Terminel et al.

(10) Patent No.: US 7,195,242 B2
(45) Date of Patent: Mar. 27, 2007

(54) ROULETTE ALTERNATIVE CARD GAME

(76) Inventors: Fernando N. Terminel, 3331 Marlette Cir., South Lake Tahoe, CA (US) 96150; Richard E. Neubauer, P.O. Box 3109, Gardnerville, NV (US) 89410

( * ) Notice: Subject to any disclaimer, the term of this patent is extended or adjusted under 35 U.S.C. 154(b) by 0 days.

(21) Appl. No.: 10/876,383

(22) Filed: Jun. 25, 2004

(65) Prior Publication Data

US 2005/0285341 A1 Dec. 29, 2005

(51) Int. Cl.
*A63F 1/00* (2006.01)
*A63F 5/00* (2006.01)

(52) U.S. Cl. ..... 273/274; 273/292; 273/138.1; 463/17

(58) Field of Classification Search ..... 273/274, 273/292, 138.1, 309; 463/12, 13, 17
See application file for complete search history.

(56) References Cited

U.S. PATENT DOCUMENTS

| | | | | | |
|---|---|---|---|---|---|
| 4,441,714 | A * | 4/1984 | Goott | 273/144 B |
| 5,184,821 | A * | 2/1993 | Korenek | 273/138.2 |
| 5,772,211 | A * | 6/1998 | Nazaryan et al. | 273/292 |
| 5,918,884 | A * | 7/1999 | DiMuro | 273/292 |
| 6,065,752 | A * | 5/2000 | Beltran | 273/274 |
| 6,264,200 | B1 * | 7/2001 | Smith | 273/274 |
| 2001/0015529 | A1 * | 8/2001 | Allen | 273/292 |

* cited by examiner

*Primary Examiner*—Benjamin Layno

(57) ABSTRACT

Card play is further enhanced by a method for playing a cards comprising; wagering whether a random card drawn will have particular, prechosen card features; indicating to the dealer which card down in the deck the card to be examined is; dealing down to that card; and paying the wager if the player has chosen the right particular, prechosen features of the card.

7 Claims, 1 Drawing Sheet
(1 of 1 Drawing Sheet(s) Filed in Color)

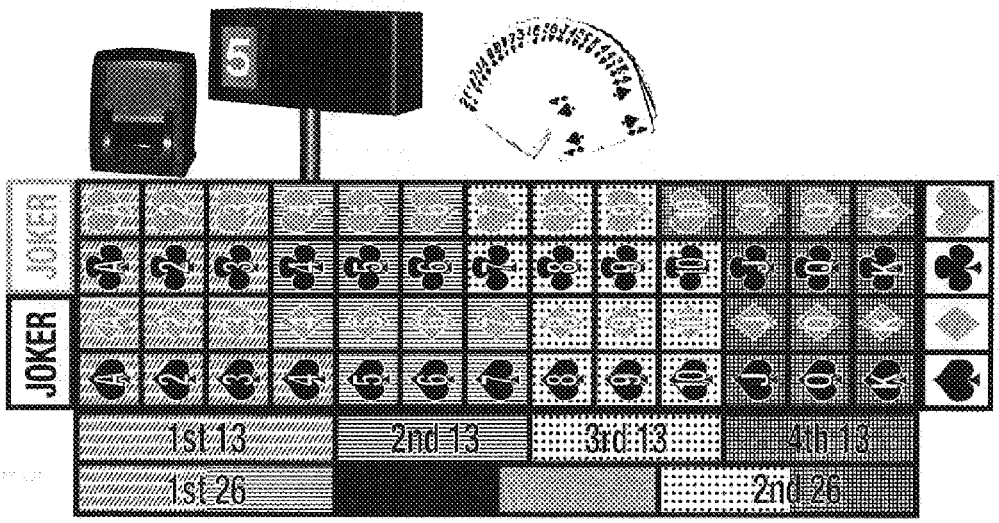
5
JOKER
JOKER
1st 13
2nd 13
3rd 13
4th 13
1st 26
2nd 26

ROULETTE ALTERNATIVE CARD GAME

FIELD OF THE INVENTION

This invention relates to methods of playing games and methods of amusement; in particular, this invention relates to methods of playing wagering games, especially wagering games in the context of a casino or other commercial venue; most particularly this invention relates to methods of playing card games at tables in a casino or other commercial venue and virtual card games in self contained games in the casino environment.

STATE OF THE ART

Roulette is played on a playing surface consisting of thirty eight squares which individually display the numbers 1 through 36 and 0 and double 0. Surrounding the inner display of the numbers are square boxes dividing the thirty six numbers into various combinations of numbers, for example the first twelve numbers, the second twelve numbers, or the third twelve numbers, rows of twelve, odds or evens, the first eighteen or the second eighteen, or black and red.

Roulette is played with a balanced wheel spinning. It would be advantageous to have an alternative method of generating the winning number.

SUMMARY OF THE INVENTION

The goal of this game is to accumulate as many playing chips as possible. The game is played on a playing surface, or a simulated playing surface, consisting of at least 54 squares, which individually represent the 52 cards of a standard playing deck and two jokers. Several other boxes may surround the card display area which represents the deck divided into suits, colors, the first, second, third, and fourth groupings of thirteen cards, and the like.

Play begins when each player places playing chips on the playing surface in a designated way to indicate the card he thinks will be drawn in a random drawing of cards. As in roulette, the player may indicate two adjacent boxes, or four adjacent boxes. Therefore combinations of 2, 4, 8, 13, or 26 cards may be chosen. After all the wagers are made, if the game is being played as a wagering game of chance, a standard 52 card deck of plying cards, plus two jokers, will be shuffled, and the player will cut a single card from the deck. This card will indicate the chosen card. If the chosen card has also been chosen by the player in the pre-shuffle game formalities, the player will be designated a winner. If the player has not indicated the chosen card, he will be a loser. In the wagering version of this game, all losing bets are removed from the table at this time, and all wagers are paid to the winners. Obviously, the amount paid to the player will vary depending on the number of cards he has chosen. After all wagers have been paid the table is ready for the next game.

It may be preferred to have a random number selector pick the number of the indicated card and have the dealer deal down the deck to that card. This can be done automatically or one can use randomizing objects such as dice, coins, and the like.

In this game, the number of players allowed, the exact payoff odds, the minimum and maximum wagers, and procedures for tracking and paying bets and for handling the cards can be left to the management of each establishment, and may vary. These housekeeping details are outside the scope of this invention.

Card play is further enhanced by a method for playing a cards comprising; wagering whether a random card drawn will have particular, prechosen card features; indicating to the dealer which card down in the deck the card to be examined is; dealing down to that card; and paying the wager if the player has chosen the right particular, prechosen features of the card.

In particular, this invention provides a method for playing a game based on random events comprising;

Indicating a player's intent by brushing a first indicator for another card, and brushing a second indicator top stand, for example, a cross may be printed on the table.

In a second embodiment, this invention provides a method for playing a game based on random events comprising;

Wagering whether a random card drawn will have particular, prechosen card features;

Indicating to the dealer which card down in the deck the card to be examined is; dealing down to that card; and Paying the wager if the player has chosen the right particular, prechosen features of the card.

DETAILED DESCRIPTION OF THE DRAWINGS

The patent or application file contains at least one drawing executed in color. Copies of this patent or patent application publication with color drawing(s) will be provided by the Office upon request and payment of the necessary fee.

FIG. 1 illustrates a roulette surface used for placing bets, playing cards and a randomization device.

DETAILED DESCRIPTION OF THE PREFERRED EMBODIMENT

Herein, a deck of cards will considered to be a deck containing a minimum of fifty two cards including an ace (A), 2, 3, 4, 5, 6, 7, 8, 9, 10, Jack (J), Queen (Q), and King (K) in the four suits of clubs, spades, hearts and diamonds. Other cards may be added to the deck, such as jokers so the total number of cards may well be higher than fifty two. However, the "deck" as defined herein will always contain at least the fifty two cards of the standard deck, and those fifty two cards will always be randomly shuffled before being dealt to the player.

As used herein, a "card" can be a physical elongate paper or plastic item with a numerical value printed thereon, or it can be a virtual card, which is defined herein is any representation of a playing card that may look identical to the numerical side of a physical card or may be abbreviated, having, for example, only a number and a suit identified thereon. Virtual cards are used in conjunction with a computer, or similar digital processing means, which will display the virtual card on a video display monitor or other active display device. As used herein, the term "video monitor" includes CRT video monitors and all equivalents of CRT video monitors such as LED screens and plasma screen displays of any sort that displays graphical images of digital information.

Obviously this game can be played without the necessity of gambling, for example in home play or charity play. Such a game would have all the features of the gambling game, but no money would exchange hands.

If virtual cards are used, that is to say a computer generated game rather than a live dealer, then the "dealer" will usually be a virtual dealer. A virtual dealer is the processor that calculates the hands and displays them to the player. In general, the player will activate the processor by dropping a coin into a slot and pressing a button. However, strictly computer driven games, that include no possibility of money changing hands are also contemplated by the invention—for example, games played at home and the like strictly for amusement or for practice for actual play in a casino. If one uses a computer style of game, the dealer's role remains unchanged from what it would be if the dealer was a live person standing or sitting at the gaming table. Therefore, as used herein, the term "dealer" will includes both live dealer and the virtual dealer created by the processor.

The dealer does not normally participate beyond dealing in most twenty-one games, but the person playing the dealer may be rotated in and out, and the dealer may play hands against himself—thereby lowering the likelihood of a player winning any given hand. There may be between one to as many as seven players in the normal casino version of the blackjack or twenty-one game, although, in theory, the number of players could be much greater.

This invention is a method of playing the game of twenty-one between either a live dealer or a virtual dealer. The dealer may be dealing either real cards or virtual cards. The dealer, live or virtual, will deal to at least one live twenty-one player.

In the game disclosed herein, the player bets on whether a random card is a particular, prechosen card. In this game, the player tells the dealer which card down in the deck he wants to wager on the value of the card. For example if the player wants to wager on the eighth card down in the deck, the deal deals out the first eight cards. If the players hunch is correct about the value of the card, then he wins. A typical payout would be about fifty two to one. Either one or two jokers can be used in the deck to give the house an advantage on the payout.

While, in principle, any card from the first card to the last could be chosen, it has been determined that the best way to facilitate this game is to limit the cards picked from the second card to the ninth. The card is picked and the dealer proceeds to deal down to the chosen card and pays off any winning wagers.

It is preferable to use a randomization device of some kind, so that neither the player nor the dealer has any fore knowledge of which card will be picked. Such randomization devices are trivial to program using any computer language that provides random numbers. One preferred device provides a button that is to be pressed at the start of the game, and the randomly chosen card number lights up an indicator at the table.

In a preferred embodiment, the player or players may place bets on a surface similar to that used in roulette. For example, a series of indicators are printed in boxes, Ace through King, and four of these series, one for each suit, are printed side by side. Then the player can place a bet on his chosen number or numbers, and then the random card is chosen. The printed array may also provide for allowing the placing bets on whether a card of the first, second, third and fourth sets of thirteen cards—that is, in one example, the ace of all suits, the two of all suits, the three of all suits, and one four from one suit. Similarly, the array may contain printed boxes for placing bets on the jokers, the suit of the chosen card, and whether the card will be a red or black suit.

Typical payoffs may vary with the casino providing the game, and this game allows some variation in payoffs without making the game too player unfriendly. One set of fairly typical odds are, for one card chosen, or one card box on the printed layout covered, the payoff will be 51 to 1. For two cards chosen, the payoff will be 25 to one, for four cards, 12 to 1, for eight cards, 5 to one, for thirteen cards—that is a bet on either which suit will show or whether a card of the first, second, third or fourth series of cards—3 to one, and for twenty six cards, 1 to 1.

This invention has been described in detail with reference to specific embodiments of the invention and examples thereof. Alterations, modifications, and other changes to those embodiments and examples will invariably suggest themselves to those of ordinary skill in the art relating to this invention. Therefore, it is intended that the scope of this invention should be determined solely by reference to the appended claims, which appended claims encompass all such alterations, modifications, and changes.

We claim:

1. A method for playing a game based on random events comprising the steps of;

Wagering whether a random card drawn from a standard deck of cards having fifty two cards in four suits of two colors and thirteen different values in each suit will have particular, prechosen card features, the features being the suit and color of the card and its value;

Indicating to a dealer which random card is to be examined, the indication being made by a randomization device, wherein the standard deck contains that card to be examined, by operating the randomization device which randomly chooses a number of cards the dealer is to deal from the top of the deck;

Dealing, according to the number chosen, the number of cards from the top of the deck, after the chosen number of cards have been dealt, the next card at the top of the deck being the random card to be examined; and Paying the wager if the player has chosen the correct particular, prechosen features of the card.

2. The method of claim 1 wherein the method further includes limiting the numbers randomly chosen by the randomization device, to the numbers two through nine, wherein the random card to be chosen being the second card down from the top card of the deck to the ninth card down.

3. The method of claim 1 wherein the method further includes using a surface similar to that used in roulette to place bets on.

4. The method of claim 3 wherein the method further includes indicating the card chosen by visual means.

5. The method of claim 1 wherein the method further includes playing the game as a virtual game on a computer.

6. The method of claim 1 wherein the method further includes paying using the odds of for one card chosen, 51 to 1; for two cards chosen, 25 to 1, for four cards chosen, 12 to 1, for eight cards chosen 5 to 1, for thirteen cards, 3 to one, and for twenty six cards, 1 to 1.

7. The method of claim 1 wherein the prechosen features of the card include the specific identity of the card, the suit of the card, whether the card is in the first, second, third or fourth sets of the thirteen cards, the sets of cards made by dividing the thirteen cards contained in a suit into three four card sets and one five card set, all of the cards in each set contained in the standard deck, and whether the card will be red or black.

* * * * *